US005730325A

United States Patent [19]

Cheung

[11] Patent Number: 5,730,325

[45] Date of Patent: Mar. 24, 1998

[54] TOY WATER GUN

[76] Inventor: David Tat Wai Cheung, 1427 Purcell Drive, Coquitlam, British Columbia, Canada, V3E 2R7

[21] Appl. No.: 650,812

[22] Filed: May 20, 1996

[51] Int. Cl.[6] ..... B67D 5/42

[52] U.S. Cl. ..... 222/79; 222/255; 222/372; 222/383.1

[58] Field of Search ..... 222/79, 255, 265, 222/275, 276, 324, 372, 383.1, 383.2

[56] References Cited

U.S. PATENT DOCUMENTS

| | | | |
|---|---|---|---|
| 4,733,799 | 3/1988 | Wiskur | 222/79 |
| 5,184,756 | 2/1993 | Amron | 222/79 |
| 5,316,183 | 5/1994 | Brovelli et al. | 222/78 |
| 5,439,139 | 8/1995 | Brovelli et al. | 222/79 |

OTHER PUBLICATIONS

"Pumps", The Encyclopedia Americana International Edition, 1992, vol. 23, pp. 1–5.

*Primary Examiner*—Kenneth Bomberg

[57] ABSTRACT

A toy water gun comprises a main housing including provisions for holding a reservoir of water, a nozzle for receiving and discharging water pumped from the reservoir, and a pump housing positioned substantially outside the main housing. The pump housing contains a pump for pumping water from the reservoir to the nozzle. The pump is operated by an actuator which comprises a rotatable driveshaft extending from the main housing to the pump housing, a transmission interconnecting the pump and the driveshaft for operating the pump in response to rotation of the driveshaft, and a drive carried by the main housing and interconnected with the driveshaft for rotating the driveshaft. The drive may comprise a manually operable hand crank rotatably mounted outside the main housing.

15 Claims, 6 Drawing Sheets

TOY WATER GUN

FIELD OF THE INVENTION

The present invention relates to water toys. More particularly, the present invention relates to toy water guns of the type designed to shoot a stream of water from a water reservoir carried by the gun.

BACKGROUND TO THE INVENTION

As is noted in U.S. Pat. No. 5,439,139 granted on Aug. 8, 1995 (Brovelli), water guns have long been very popular toys. Some are simple squeeze toys. Others rely upon air or water pressure to eject water from the gun when a trigger is pulled. But, when the trigger is pulled, the user has no control over the rate at which water is ejected and the rate may diminish as the pressure falls. Many toy water guns incorporate a trigger operated piston and cylinder arrangement whereby a pull of the trigger leads to a piston stroke which ejects water from the cylinder. However, the volume of water which can be ejected with the momentary pull of a trigger is limited.

The Brovelli patent itself discloses a water gun which utilizes two single-action reciprocating water pumps, each comprising a piston and cylinder which serve to discharge water from the gun. The pumps are contained in the main body of the gun and are actuated by a handle which when pushed and pulled back and forth causes the pistons to stroke back and forth. Provided that the back and forth action is smooth and continuous, it is characteristic of the Brovelli design to eject a relatively continuous stream of water. This characteristic is achieved by arranging the pumps to operate out of phase with each other, one piston is moving on a delivery stroke while the other is moving on a suction stroke. However, the required back and forth movements can be jerky or erratic. Consequently, it can be relatively difficult to maintain a good aim while making such movements. The same can be true with other water guns which depend upon linear movements to eject water.

Further, in the design of known toy water guns the volume rate of water flow is typically a function of the user's ability to speed up or slow down his movements, and is limited by the mechanics of the particular water pump actuating mechanism which goes with the gun. The designs are relatively inflexible because the particular pump mechanism is typically built into the main body of the gun with little or no available space to substitute different mechanisms which may have substantially increased volume handling capacity. Manufacturers cannot easily accommodate differing user preferences.

A primary object of the present invention is to provide a new and improved toy water gun which better facilitates the use of differing water pump mechanisms with the same pump driving mechanism.

A further object of the present invention is to provide a new and improved toy water gun where the user's aim is not disrupted by linear back and forth movements.

SUMMARY OF THE INVENTION

In accordance with a broad aspect of the present invention, there is provided a toy water gun comprising a main housing including means for holding a reservoir of water, a nozzle means for receiving and discharging water pumped from the reservoir, and a pump housing positioned substantially outside the main housing. The pump housing contains a pumping means for pumping water from the reservoir to the nozzle. The pumping means is operated by an actuating means which comprises a rotatable driveshaft extending from the main housing to the pump housing, a transmission means interconnecting the pumping means and the driveshaft for operating the pumping means in response to rotation of the driveshaft, and means carried by the main housing and interconnected with the driveshaft for rotating the driveshaft.

Preferably, the means for rotating the driveshaft comprises a manually operable hand crank rotatably mounted outside the main housing. As well, the main housing preferably has the configuration of a rifle, including a rearward portion having the configuration of a rifle stock, an intermediate portion extending forwardly from the rearward portion, and a barrel extending forwardly from said intermediate portion; the hand crank being mounted on a side of the intermediate portion, and the pump housing being positioned above the intermediate portion.

The use of a rotatable hand crank rather than linear back and forth movement to operate the pumping means advantageously permits a more continuous operation because a hand crank can be turned continuously. Further, a hand crank permits a smoother operation which is less likely to detract from a user's aim than the jerky, interrupted motion which will be typically characteristic of back and forth movement.

The placement of the pumping means in a housing outside the main housing readily permits a variety of differing pump housings, or differing pumping means within the same or differing pump housings, to be selectively used with the same or substantially the same main housing, including the same or substantially the same pump drive mechanism carried in the main housing. This is desirable from a manufacturer's point of view because it enables the manufacturer to develop and offer a family of toy water guns with differing performance characteristics but without having to completely retool for each water gun in the product line. From a user's point of view, the offering of a such product line can be desirable because the user will then have a choice.

For example, the pumping means may be a single single-action reciprocating pump. However, if single-action reciprocating pumps are used, then the use of a pair of such pumps operating 180 degrees out of phase is generally preferred because the water output will then be relatively continuous and not intermittent. As an alternative, two pairs of single-action reciprocating pumps may be used—not only to increase the overall rate of flow for a given size of individual pump, but also to maintain a more constant rate of flow if the pumps are operated sequentially 90 degrees out of phase with respect to each other. A relatively constant rate of flow may also be achieved with three single-action reciprocating pumps operating sequentially 120 degrees out of phase. Other pumping mechanisms may be used. For example, a double-action reciprocating pump may be used to perform the function of two single-action reciprocating pumps. The pump housings associated with any one or more of such pumping mechanisms may be made compatible with a given main housing, but at the same time may be given substantially different outward appearances to convey the message of a different product or model within the same product line or family of products.

The foregoing and other features and advantages of the invention will now be described with reference to the drawings.

DETAILED DESCRIPTION

Figure 1:
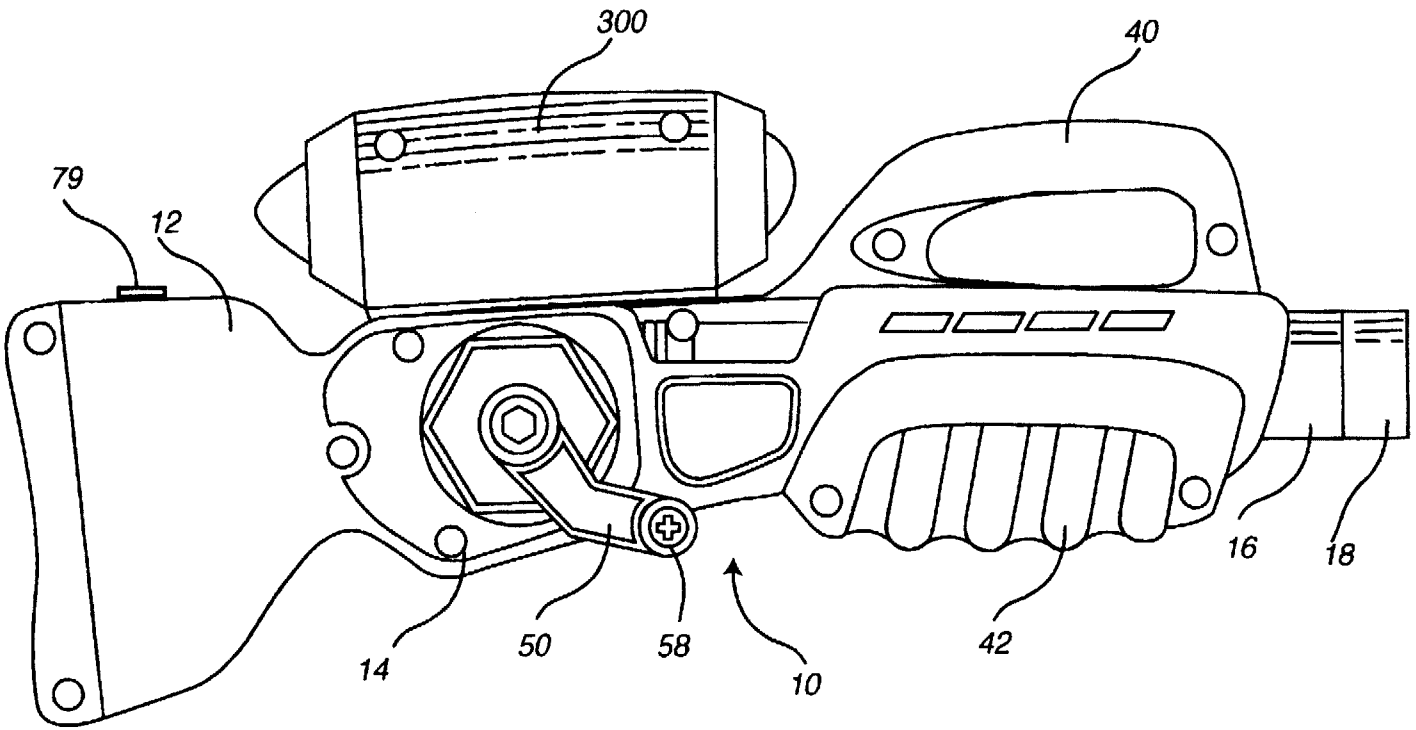
FIG. 1 is a side elevation view of a toy water gun in accordance with the present invention.

Referring now to FIGS. 1 to 6, there is shown a toy water gun comprising a main housing generally designated 10 and a pump housing generally designated 300. Main housing 10 includes a rearward portion 12 having the configuration of a rifle stock, an intermediate portion 14 extending forwardly from rearward portion 12, and a barrel 16 extending forwardly from intermediate portion 14 to a muzzle 18 which forms part of the barrel. The main housing and the pump housing are both fabricated from plastic—preferably a high impact polystyrene for strength and durability. Further, they each have a shell construction which is split longitudinally to facilitate construction and assembly of the gun.

Figure 4:
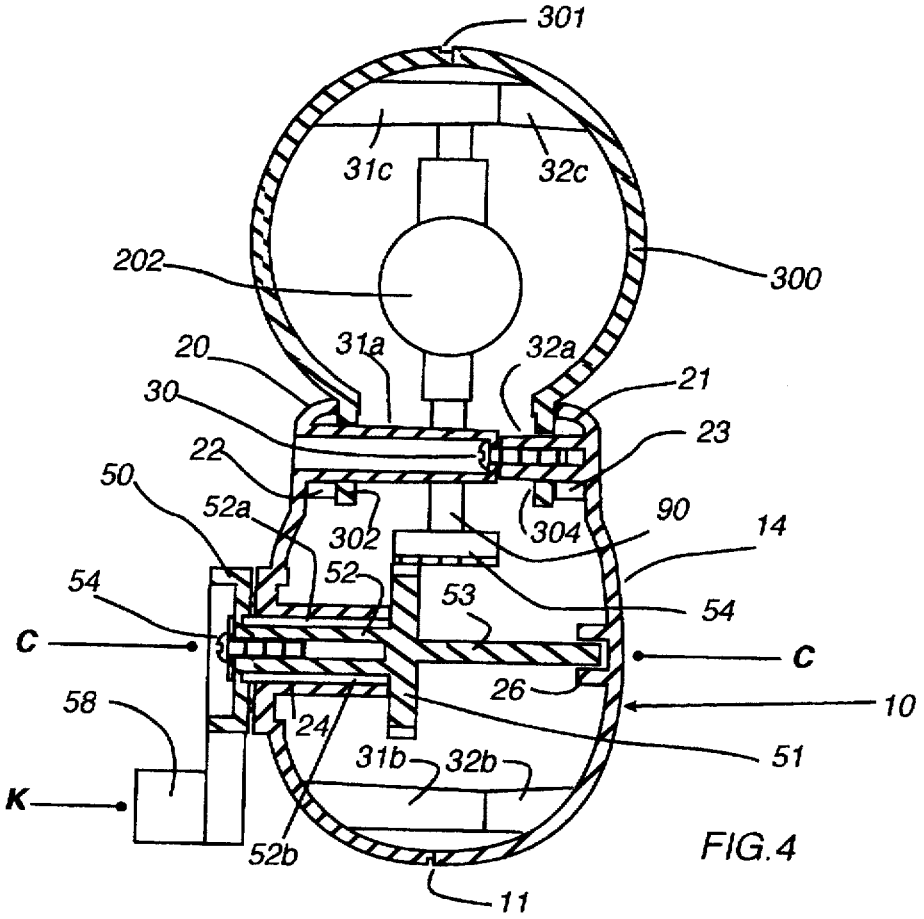
FIG. 4 is a transversally sectioned elevation view showing an intermediate portion of the main housing, the pump housing and the pump actuating mechanism of the water gun shown in FIG. 1
Figure 6:
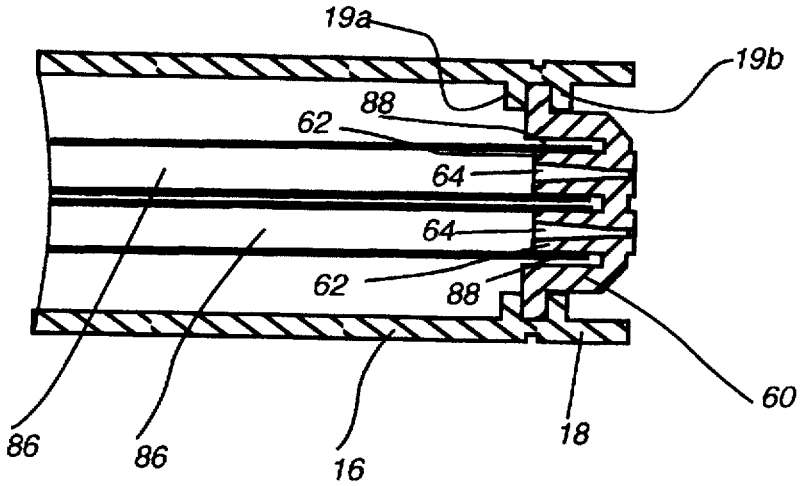
FIG. 6, which is on the same sheet of drawings as FIG. 4, is a longitudinally sectioned side elevation view showing a forward portion of the barrel and nozzle of the water gun shown in FIG. 1.

Pump housing 300 is positioned substantially outside main housing 10 and above intermediate portion 14. As best seen in FIG. 4, a pair of opposed flanges 302, 304 formed integrally with the wall of housing 300 extend downwardly into the top portion of housing 10 where they are abuttingly engaged by opposed upper ends 20, 21 of intermediate portion 14, and by opposed register tabs 22, 23 formed integrally with the wall of portion 14. The engagement becomes a tight fitting, secure engagement as the left and right hand sides of portion 14 are drawn together by tightening tie bolt 30.

Tie bolt 30 is part of one of a number of similar bracing structures which serve to join together opposed longitudinally split halves of housing 10 and, as well, opposed longitudinally split halves of housing 300. In FIG. 4, it will be noted that the bottom of housing 10 is split at 11, and that the top of housing 300 is split at 301. As best revealed by the example of the bracing structure shown in section in FIG. 4 (viz. as part of intermediate portion 14 of housing 10), each such structure includes a cylindrical guide member 31 (viz. 31*a*) formed integrally with one side of the housing and a sleeve member 32 (viz. 32*a*) formed integrally with the opposed side of the housing. Bolt 30 is first inserted through guide member 31*a*. Then, it is threaded into sleeve member 32*a* to hold the sides of the housing together. (In the Figures, various guide members 31 and sleeve members 32 have been designated, each with a differing letter suffix. While these structures are essentially the same, the differing suffixes merely indicate that their lengths may vary depending upon their respective positions in the housing of which them form part.)

Figure 2:
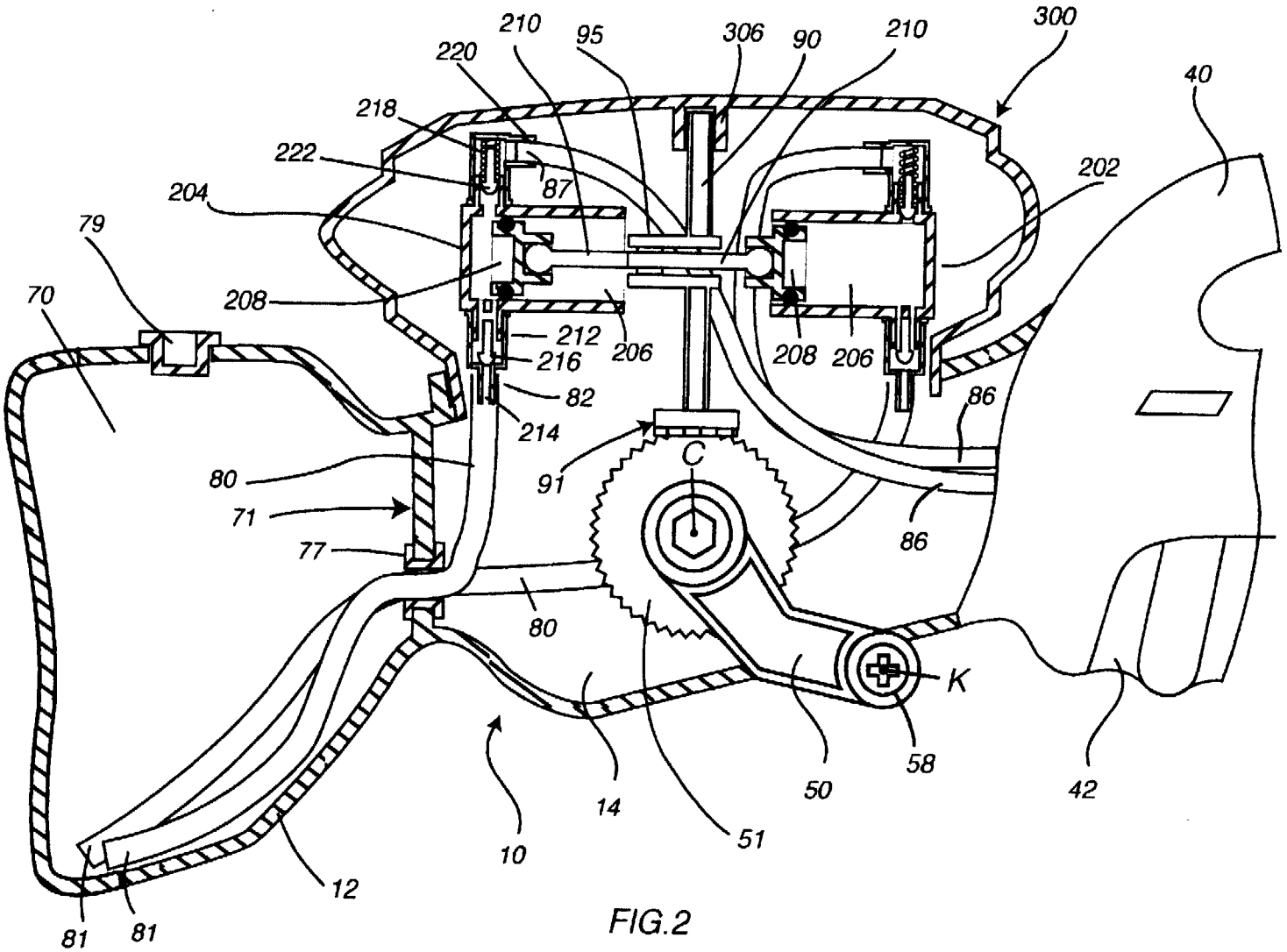
FIG. 2 is a longitudinally sectioned side elevation view of a rearward portion of the gun shown in FIG. 1.
Figure 3:
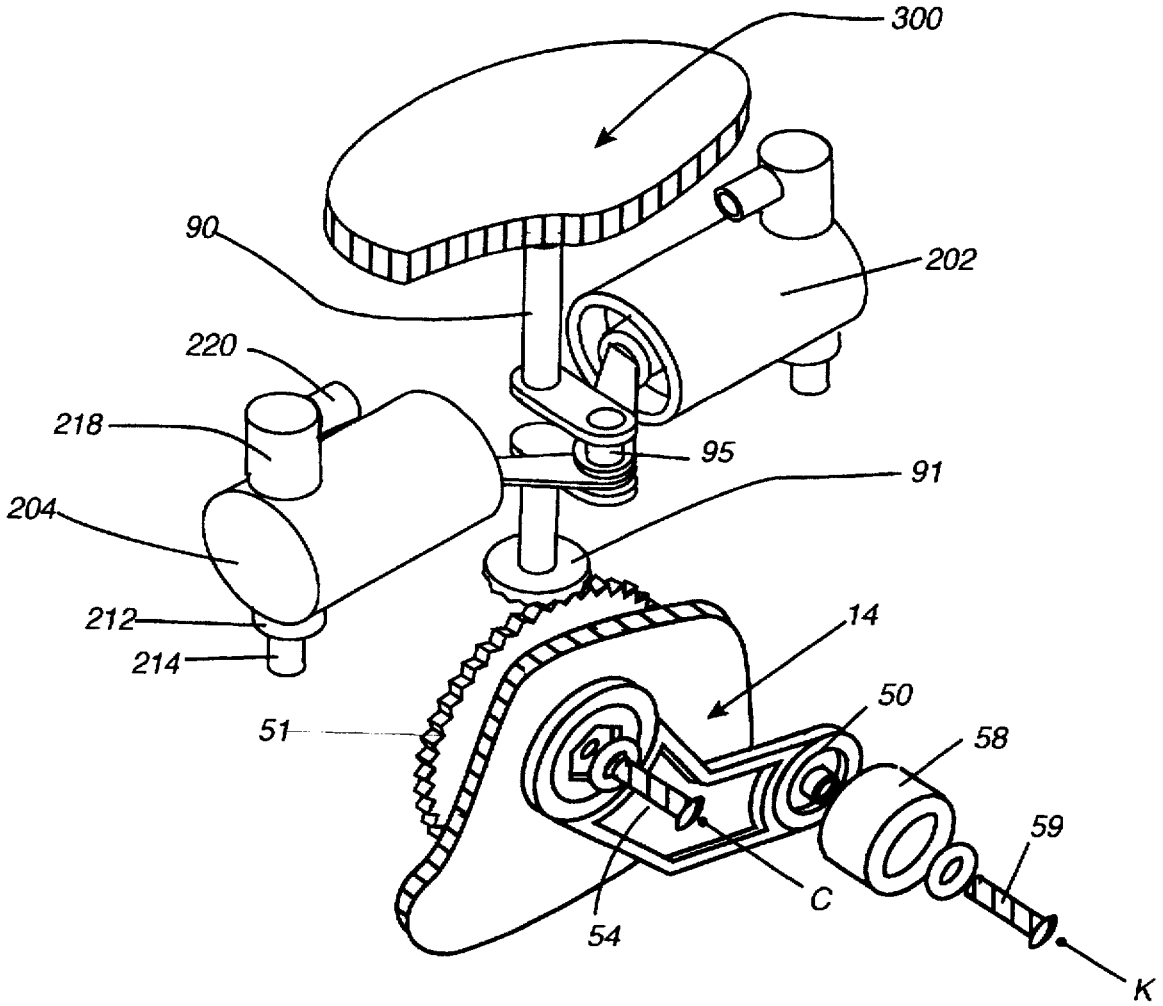
FIG. 3 is an exploded perspective view showing the pump actuating mechanism of the water gun shown in FIG. 1.
Figure 5:
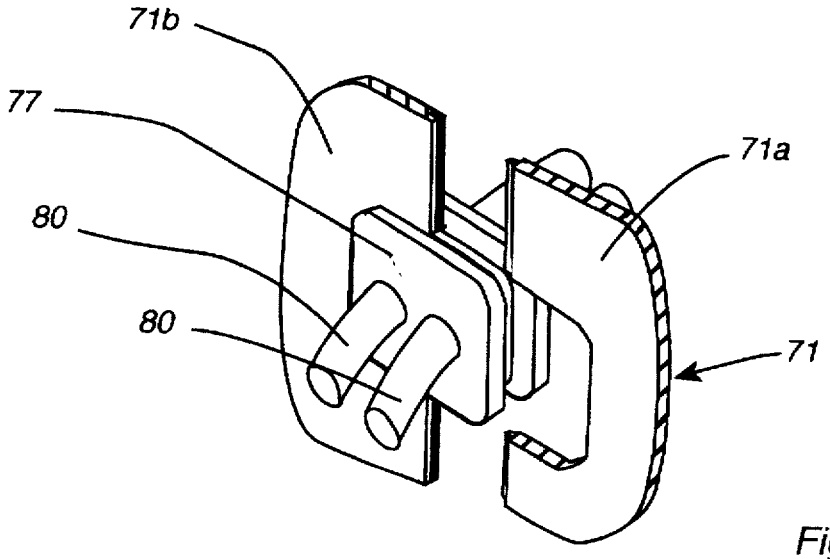
FIG. 5, which is on the same sheet of drawings as FIG. 3, is a perspective view showing in more detail the partition wall and tube connector fitting in the rearward portion of the water gun shown in FIG. 1.

As can be seen in FIG. 2, housing 300 contains a pumping means comprising a pair of single-action reciprocating pumps 202, 204, each pump including a cylinder 206, piston 208 and piston rod 210. The piston rods are each connected to an eccentric 95 of a rotatable driveshaft 90 such that the two pumps operate 180 degrees out of phase with respect to each other upon rotation of the driveshaft. When piston 208 of pump 202 is fully on its suction stroke as shown in FIG. 2, then corresponding piston 208 of pump 204 is fully on its delivery stroke, also as shown in FIG. 2.

To receive and direct water flow, each pump 202, 204 includes a water inlet 212 with an inlet valve 216, and a water outlet 218 with a spring biased outlet valve 222. The water inlet of each pump includes an end portion 214 having a reduced outside diameter which press fits into the water outlet end 82 of an associated water inlet tube 80. Two inlet tubes 80 are used, one for each of the two pumps 202, 204. They are formed from flexible tubing and connect inlet 212 of the associated pump in water flow communication with a water chamber 70 in the rearward or stock portion 12 of main housing 10. As best seen in FIG. 2, water inlet ends 81 of tubes 80 extend to the lowermost region of chamber 70. Water is added to the chamber by removing fill cap 79 fitted at the top of stock portion 12.

To serve as a reservoir for water, it will be noted that chamber 70 is partitioned from intermediate portion 14 of the housing by a partition wall 71. A connector fitting 77 (best seen in FIG. 5) serves to secure and guide tubes 80 through the wall and, with a radially inward press fit on the tubes, seals the wall around the tubes.

During assembly of the gun, fitting 77 with tubes 80 extending therethrough is positioned in alignment to be completely engaged by partition wall 71 as the longitudinally split halves of housing 10 are brought together. However, since the housing has a split construction, partition wall 71 necessarily has a split construction. As illustrated in more detail in FIG. 5, wall 71 comprises two coplanar sides 71*a*, 71*b*, side 71*a* including tongues extending along its vertical inner end portions, and side 71*b* including mating grooves extending along its corresponding inner end portions. When the split halves of housing 10 are brought together, sides 71*a* and 71*b* mate together. Concurrently, they form a tight fitting engagement with connector 77.

To avoid the escape of water from chamber 70 when the split halves of housing 10 are brought together, the halves should be glued or ultrasonically welded along the dividing line between the halves around the chamber. This dividing line will include not only that portion of the split which extends around chamber 70 on stock portion 12, but also the line between sides 71*a* and 71*b* of partition wall 71.

The water outlet 218 of each pump includes an end portion 220 connected with a water inlet end 87 of a water discharge tube 86. Water tubes 86 (one for each of the two pumps 202, 204) are formed from the same flexible tubing material as water tubes 80. For each pump, the associated discharge tube 86 connects outlet 218 through barrel 16 in water flow communication with a nozzle means 60 (see FIG. 6) held in the barrel at muzzle 18 between annular flanges 19*a*, 19*b*. Nozzle means 60 includes a pair of bosses 62 over which the water outlet end 88 of an associated one of the water tubes 86 is press fitted. Each boss includes a centrally disposed tapered hole 64 through which water will jet out when pumped down the associated tube 86.

The water gun shown in FIGS. 1 to 6 also includes a manually operable hand crank 50 rotatably mounted on a side of intermediate portion 14 outside main housing 10.

Crank 50 is axially coupled to a drive gear 51 which engages a pinion gear 91 mounted at the lower end of driveshaft 90. To better facilitate operation of the crank as it rotates about crank axis C, a holding knob 58 is mounted at the free end of the crank by means of a bolt 59 but is permitted to rotate freely about knob axis K (see FIG. 4)

In more detail, it will be observed in FIG. 4 that drive gear 51 is supported on one side by a hollow axle 52 and on the other side by a solid axle 53, both axles being integrally formed with gear 51 and centered along crank axis C. Axle 53 is slidingly received for free rotation about axis C in a short support sleeve 26 forming part of intermediate portion 14 on the right hand side in FIG. 4. Axle 52 is slidingly received by an elongated sleeve 24 forming part of intermediate portion 14 of main housing 10 on the left hand side in FIG. 4, and is free to rotate about axis C within sleeve 24. Crank 50 is secured to axle 52 by means of a bolt 54 threadingly engaged into the hollow bore of the axle. However, to avoid radial stress on the bolt connection as the crank is turned, axle 52 includes a pair of radially extending longitudinal flanges **52*a*, 52*b* each of which key into crank 50**.

In FIG. 2, it will be noted that driveshaft 90 extends upwardly from intermediate portion 14 of housing 10 to a point near the top of housing 300 where it slidingly received by a short sleeve 306 forming part of pump housing 300. Sleeve 306 permits the driveshaft to rotate freely within the sleeve while stabilizing and maintaining the vertical alignment of the driveshaft.

Finally, as best seen in FIG. 1, it will be observed that the gun includes a handle grip 40 positioned above the barrel and a forearm grip 42 positioned below the barrel.

The operation of the water gun shown in FIGS. 1 and 2 will be readily apparent. When hand crank 50 is rotated or turned about its axis C, drive gear 51 turns pinion gear 91 which in turn rotates driveshaft 90. As driveshaft 90 rotates, pumps 202 and 204 are caused to reciprocate. In accordance with the well known mechanics and operation of reciprocating pumps, they alternately draw water from reservoir 70 via tubes 80 and discharge that water via tubes 89 through nozzle means 60. Since pumps 202, 204 are set to operate 180 degrees out of phase, the gun will discharge a substantially continuous stream of water so long as the cranking motion is continuous and so long as water remains in the reservoir.

Handle grip 40 may be used as a simple carrying handle. As well, and this is a matter of user preference, it may be used to grip the gun from above (rather than from below with forearm grip 42) when the gun is being fired. In this regard, it would be usual to use the forearm grip if the gun is fired with the rearward or stock portion 12 braced against the shoulder. However, when firing from other positions—for example, from the hip—then some may prefer to grasp from the top using handle grip 40.

It will be readily apparent to those skilled in the art that driveshaft operated pumping mechanisms other than the two single-action reciprocating pumps shown in FIG. 2 may be used in housing 300 Some workshop design modifications may be required on the driveshaft to accommodate different pumps. Otherwise, however, the main housing 10, hand crank and coupling of the hand crank to the driveshaft may remain substantially the same. One variation would be to simply remove either pump 202 or 204. For a given driveshaft speed the volume rate of water flow over each complete cycle would then be reduced by half. Also, however, the flow would be an intermittent flow which may be considered by some to be undesirable. As first indicated above, another variation would be to replace pumps 202, 204 with a double-action reciprocating pump which could have more capacity, less capacity or the same capacity as the combined capacity of pumps 202 and 204.

In any case, by segregating the pump housing from the main housing differing pumping mechanisms with similar or differing pumping characteristics may be readily substituted for the mechanism given.

Figure 7:
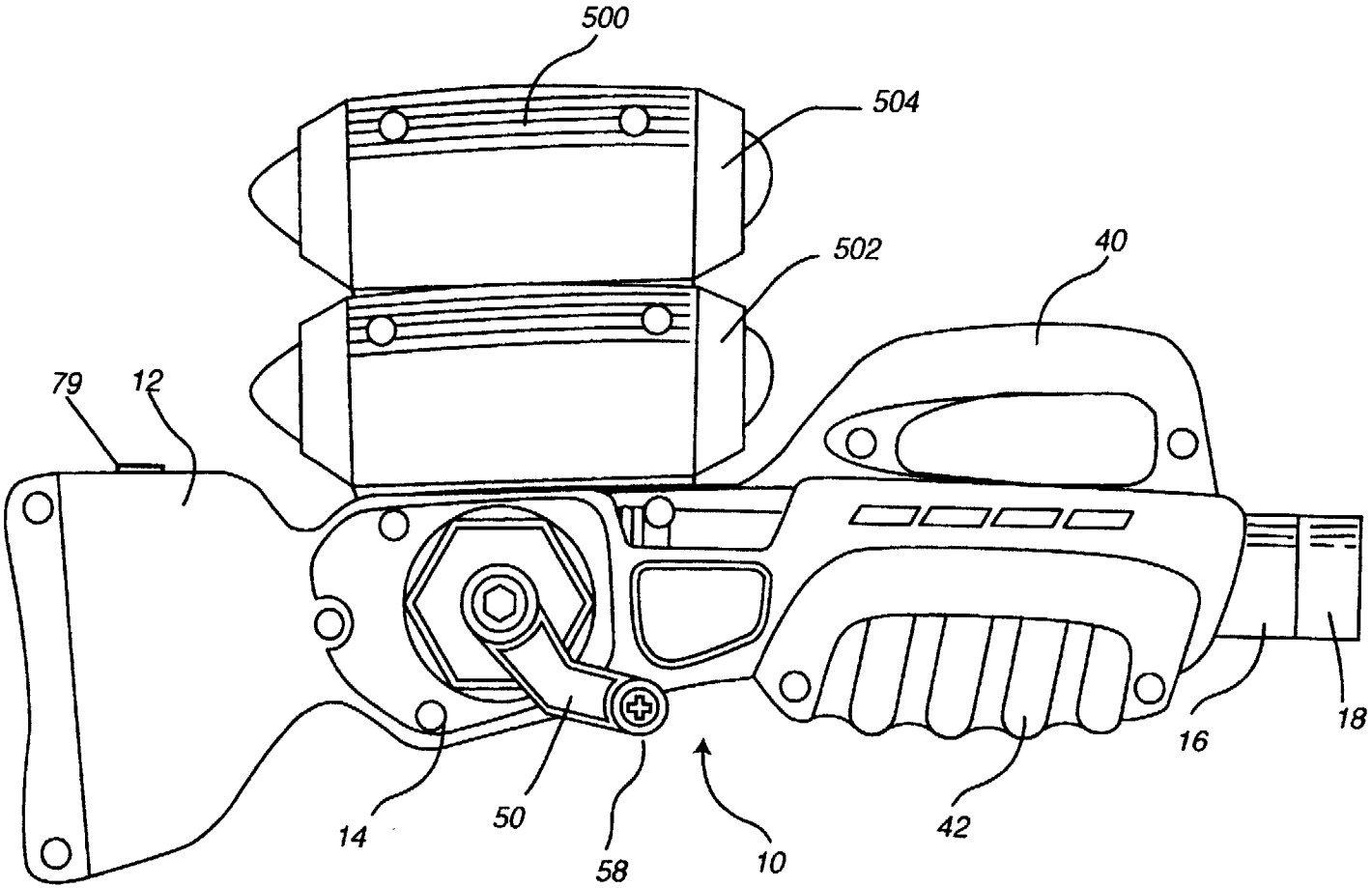
FIG. 7 is a side elevation view of another toy water gun in accordance with the present invention, similar to that which is shown in FIG. 1, but which includes two pairs of pumps.
Figure 8:
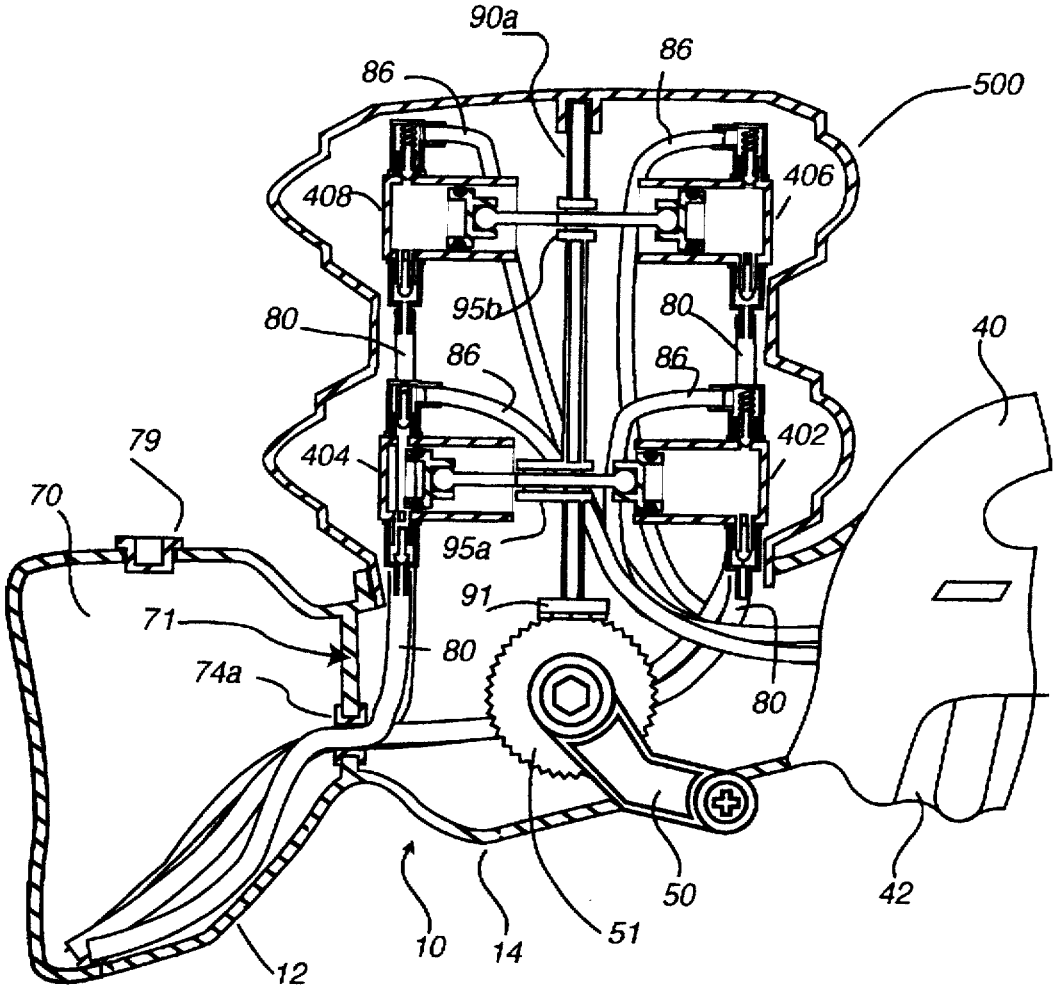
FIG. 8 is longitudinally sectioned side elevation view of a rearward portion of the gun shown in FIG. 6.

FIGS. 7 and 8 illustrate an embodiment of the invention which utilizes a pumping means comprising two pairs of single-action reciprocating pumps: viz. pumps 402 and 404 constituting one pair; pumps 406 and 408 constituting the other. All such pumps are contained within a reconfigured pump housing 500 which is used in conjunction with basically the same main housing 10 as used for the embodiment of FIGS. 1 to 6. However, with twice the number of pumps, it will be apparent that the volume handling capacity of the embodiment shown in FIGS. 7 and 8 may be twice that of the embodiment shown in FIGS. 1 to 6 (assuming of course that the capacity of the individual pumps in each embodiment is substantially the same).

As shown in FIG. 7, pump housing 500 has the outward appearance of two pump housings 502, 504 stacked one on the other above intermediate portion 14 of housing 10. However, this is an aesthetic design consideration meant to better convey the message that a gun like that shown in FIG. 7 has more power than a gun like that shown in FIG. 1. In fact, as will be evident from FIG. 8, housing 500 is a single housing.

Each pair of pumps 402, 404 and 406, 408 as shown in FIG. 8 is driven by a driveshaft **90*a* in essentially the same manner as the pair of pumps 202, 204 is driven by driveshaft 90 in the embodiment shown in FIG. 2. Driveshaft 90*a* is longer than driveshaft 90 in order to extend past both pair of pumps, and includes two eccentrics 95*a*, 95*b* rather than one as in FIG. 2. Otherwise, the primary difference worthy of note is the relative angular orientation of the eccentrics. In this regard, pumps 402, 404 are driven 180 degrees out of phase by eccentric 95*a*. Likewise, pumps 406, 408 are driven 180 degrees out of phase by eccentric 95*b*. However, eccentric 95*b* is rotated 90 degrees on the driveshaft axis with respect to eccentric 95*a*. Thus, when the piston of pump 402 is fully on its suction stroke and the piston of pump 404 is fully on its delivery stroke as shown in FIG. 8, then the pistons of pumps 406 and 408 will be half way through their respective suction and delivery strokes. In other words, the pumps will operate sequentially 90 degrees out of phase with respect to each other upon rotation of driveshaft 90*a***. So arranged, there will be a greater continuity of water flow than can be achieved with the use of only two single-action reciprocating pumps.

The remaining differences between the embodiment of FIGS. 7 and 8 and the embodiment of FIGS. 1 to 6 are minor, but are as follows. Firstly, there are four water inlet tubes 80 rather than two which extend into water chamber 70 (viz. one for each of the four pumps). Fitting **74*a* in FIG. 8 is necessarily structured to accommodate four inlet tubes 80 rather than two as in the case of fitting 74 in FIG. 2. Secondly, there are four water discharge tubes 86 rather than two which will extend to a nozzle means (not shown) similar to nozzle means 60 in FIG. 5**, but structured to accommodate the four rather than two discharge tubes.

In operation, the essential difference between the embodiment shown in FIGS. 7 and 8 and the embodiment shown in FIGS. 1 to 6 is as indicated above. For the same size of pumps and a given driveshaft speed the former will deliver twice the volume rate of water flow. Thus, it will be apparent that the present invention permits a selection of different pumping mechanisms to be offered with only minor modification within the main housing.

The present invention may be embodied in other specific forms without departing from its spirit or essential characteristics, and the embodiments which have been described are to be considered in all respects only as illustrative and not as restrictive. Various changes and modifications are possible and will undoubtedly occur to those skilled in the art.

Accordingly, the scope of the invention is indicated by the appended claims rather than by the foregoing description. All changes or modifications which come within the meaning and range of equivalency of the claims are considered to be embraced within their scope.

I claim:

1. A toy water gun, comprising:

(a) a main housing including means for holding a reservoir of water;

(b) a nozzle means for receiving and discharging water pumped from said reservoir;

(c) a pump housing positioned substantially outside said main housing, said pump housing containing a pumping means for pumping water from said reservoir to said nozzle means; and, (d) actuating means for operating said pumping means, said actuating means comprising:

(i) a rotatable driveshaft extending from said main housing to said pump housing;

(ii) transmission means interconnecting said pumping means with said driveshaft for operating said pumping means in response to rotation of said driveshaft; and, (iii) means carried by said main housing and interconnected with said driveshaft for rotating said driveshaft.

2. A toy water gun as defined in claim 1, wherein said means for rotating said driveshaft comprises a manually operable hand crank rotatably mounted outside said main housing.

3. A toy water gun as defined in claim 2, wherein said pumping means comprises a reciprocating pump.

4. A toy water gun as defined in claim 2, wherein said main housing comprises:

(a) a rearward portion having the configuration of a rifle stock;

(b) an intermediate portion extending forwardly from said rearward portion; and, (c) a barrel extending forwardly from said intermediate portion, said hand crank being mounted on a side of said intermediate portion, said pump housing being positioned above said intermediate portion.

5. A toy water gun as defined in claim 4, further including a handle grip positioned above said barrel portion and a forearm grip positioned below said barrel portion.

6. A toy water gun as defined in claim 1, wherein said pumping means comprises a pair of water pumps.

7. A toy water gun as defined in claim 6, wherein said means for rotating said driveshaft comprises a manually operable hand crank rotatably mounted outside said main housing.

8. A toy water gun as defined in claim 7, wherein said pumps are single-action reciprocating pumps, said transmission means interconnecting said pumps with said driveshaft for operating said pumps 180 degrees out of phase with respect to each other in response to rotation of said driveshaft.

9. A toy water gun as defined in claim 8, wherein said main housing comprises:

(a) a rearward portion having the configuration of a rifle stock;

(b) an intermediate portion extending forwardly from said rearward portion; and, (c) a barrel extending forwardly from said intermediate portion, said hand crank being mounted on a side of said intermediate portion, said pump housing being positioned above said intermediate portion.

10. A toy water gun as defined in claim 9, further including a handle grip positioned above said barrel portion and a forearm grip positioned below said barrel portion.

11. A toy water gun as defined in claim 1, wherein said pumping means comprises first and second pairs of water pumps, said second pair of pumps being contained in said pump housing above said first pair of pumps.

12. A toy water gun as defined in claim 11, wherein said means for rotating said driveshaft comprises a manually operable hand crank rotatably mounted outside said main housing.

13. A toy water gun as defined in claim 12, wherein said pumps are single-action reciprocating pumps, said transmission means interconnecting said pumps with said driveshaft for operating said pumps sequentially 90 degrees out of phase with respect to each other in response to rotation of said driveshaft.

14. A toy water gun as defined in claim 13, wherein said main housing comprises:

(a) a rearward portion having the configuration of a rifle stock;

(b) an intermediate portion extending forwardly from said rearward portion; and, (c) a barrel extending forwardly from said intermediate portion, said hand crank being mounted on a side of said intermediate portion, said pump housing being positioned above said intermediate portion.

15. A toy water gun as defined in claim 14, further including a handle grip positioned above said barrel portion and a forearm grip positioned below said barrel portion.

* * * * *